US010036117B2

(12) United States Patent
Rosa et al.

(10) Patent No.: US 10,036,117 B2
(45) Date of Patent: Jul. 31, 2018

(54) IRON STRUCTURE

(71) Applicant: De' Longhi Appliances S.r.l. Divisione Commerciale ARIETE, Campi Bisenzio, Province of Florence (IT)

(72) Inventors: Carlo Rosa, Lecco (IT); Michele Picchi, Pontedera (IT)

(73) Assignee: DE' LONGHI APPLIANCES S.R.L. DIVISIONE COMMERCIALE, Campi Bisenzio (IT)

( * ) Notice: Subject to any disclaimer, the term of this patent is extended or adjusted under 35 U.S.C. 154(b) by 0 days.

(21) Appl. No.: 15/171,761

(22) Filed: Jun. 2, 2016

(65) Prior Publication Data

US 2017/0016174 A1 Jan. 19, 2017

(30) Foreign Application Priority Data

Jul. 14, 2015 (IT) ..... 10201533884

(51) Int. Cl.

| | |
|---|---|
| ***D06F 75/16*** | (2006.01) |
| ***D06F 75/20*** | (2006.01) |
| *D06F 75/24* | (2006.01) |
| *D06F 75/26* | (2006.01) |

(52) U.S. Cl.

CPC ..... *D06F 75/16* (2013.01); *D06F 75/20* (2013.01); *D06F 75/24* (2013.01); *D06F 75/26* (2013.01); *D06F 75/265* (2013.01)

(58) Field of Classification Search

CPC ..... D06F 75/08; D06F 75/26; D06F 75/265; D06F 75/38; F22B 1/30; A61H 33/065

See application file for complete search history.

(56) References Cited

U.S. PATENT DOCUMENTS

| | | | | |
|---|---|---|---|---|
| 1,830,875 A * | 11/1931 | Izumiya | F24H 1/00 38/77.2 |
| 2,188,011 A * | 1/1940 | Miller | D06F 75/16 38/77.81 |
| 2,189,709 A * | 2/1940 | Deems | D06F 75/16 38/77.82 |

(Continued)

FOREIGN PATENT DOCUMENTS

| | | |
|---|---|---|
| DE | 3819132 | 12/1989 |
| GB | 679657 | 9/1952 |

OTHER PUBLICATIONS

Search Report and Written Opinion for Italian Application No. ITUB20152147, dated Nov. 6, 2015, 8 pages.

*Primary Examiner* — Ismael Izaguirre

(74) *Attorney, Agent, or Firm* — Stetina Brunda Garred and Brucker

(57) ABSTRACT

There is described an improved iron structure comprising a soleplate provided with through holes for steam adapted to come into contact with the fabrics to be treated, a boiler adapted to produce steam fluidly connected to the soleplate, a duct for introducing water into the boiler, heating means and a control button functionally connected to the boiler and arranged to obtain the delivery of steam through the through holes of the soleplate. In particular, the boiler is produced as fluid-tight coupling between the soleplate and a cover portion to form a boiler compartment in which the water is boiled and in which during use of the iron the hot water-steam balance is established.

8 Claims, 6 Drawing Sheets

(56) References Cited

U.S. PATENT DOCUMENTS

| | | | | | |
|---|---|---|---|---|---|
| 2,278,370 | A | * | 3/1942 | Hoffman | D06F 75/12<br>38/77.83 |
| 2,317,716 | A | | 4/1943 | Bassett | |
| 2,323,225 | A | | 6/1943 | Ledbetter | |
| 2,343,555 | A | | 3/1944 | Huffman | |
| 2,419,705 | A | | 4/1947 | Busch et al. | |
| 2,810,218 | A | | 10/1957 | Hoecker | |
| 4,206,340 | A | * | 6/1980 | Osrow | D06F 75/16<br>219/245 |
| 4,496,826 | A | * | 1/1985 | Osrow | D06F 75/14<br>219/245 |

* cited by examiner

IRON STRUCTURE

CROSS-REFERENCE TO RELATED APPLICATIONS

The present application claims priority to Italian Patent Application No. 102015000033884 filed Jul. 14, 2015, the entirety of the disclosure of which is expressly incorporated herein by reference.

STATEMENT RE: FEDERALLY SPONSORED RESEARCH/DEVELOPMENT

Not Applicable

BACKGROUND

The present invention relates to an improved iron structure used mainly, but not necessarily, in the domestic field.

Various types of irons are known, including those with integrated boiler commonly used in the domestic environment.

In particular, the boiler is an independent component integrated in the body of the iron and is—as known—functionally associated with an electric heating element for heating the water. The boiler is in turn fluidly connected to the soleplate of the iron to generate a flow of steam, in feedback to a command given by the user on a button to activate the steam, which exits from the holes produced on the soleplate.

More in particular, the boiler defines a boiler compartment in which the water reaches boiling temperature and in which a hot water-steam balance is established.

In a first functional aspect, in order achieve good results when ironing, it is important for the flow of steam exiting from the soleplate of the iron not to be contaminated by water droplets in liquid phase.

In a second aspect, it is instead important for the heat generated by the heating element to be as uniform as possible along the whole of the path of the heating element.

These and other aspects are mainly dictated by the structure of the boiler present in the iron and by how this is heated.

For example, it is found that in order to prevent the problem of water droplets exiting from the soleplate, the user must not overfill the boiler compartment with water, by exceeding the maximum level. In irons according to the prior art it is possible to see the level of water introduced into the boiler compartment through a window. In other cases, a graduated measuring cup is instead provided to allow the user to know the right amount of water to refill the boiler when it is empty. However, the window for viewing the level and the measuring cup do not prevent the problem from occurring, for example due to loss of the measuring cup or because the boiler is not completely empty when it is refilled.

Therefore, there is the need to solve these problems in order to improve the functionality and efficiency of the iron with respect to those of the prior art.

Steaming iron according to the prior art are describes for example in U.S. Pat. No. 2,317,713, U.S. Pat. No. 2,419,705, U.S. Pat. No. 2,343,555.

BRIEF SUMMARY

The object of the present invention is therefore to provide an improved iron structure that is functionally more efficient, more compact and lighter for the user with respect to irons according to the prior art.

Another object of the present invention is to provide an improved iron structure that has fewer components and is therefore simpler to produce both with regard to costs and construction.

These and other objects are achieved by an improved iron structure comprising:

- a soleplate provided with through holes for steam adapted to come into contact with the fabrics to be ironed,
- a boiler adapted to produce steam, fluidly connected to said soleplate;
- a duct for introducing water into said boiler;
- heating means associated with said boiler;
- a control button functionally connected to the boiler and arranged to obtain the delivery of steam through the through holes of said soleplate;

wherein said boiler is produced as fluid-tight coupling between said soleplate and a cover portion to form a boiler compartment in which the water is boiled and in which during use of the iron the hot water-steam balance is established.

Advantageously, said cover portion is shaped in the form of a bowl that couples with the soleplate to form said boiler compartment, said boiler compartment comprising:

- a bottom wall defined by said soleplate,
- a top wall, opposite said bottom wall, and lateral walls comprised between the bottom wall and the top wall, defined by said cover portion.

On said cover portion there being advantageously arranged said button and said duct for introducing water.

In particular, said duct extends between an upper end that defines a mouth for introducing water and a lower end, opposite the upper end, provided with a wall that extends laterally to said duct between said upper end towards said lower end, so that the lower end of the wall delimits and circumscribes the access to the boiler compartment so that the level of water introduced into the boiler compartment cannot exceed a predetermined maximum level.

In this way, even if the user introduces an excessive amount of water into the duct, the level of water in the boiler cannot rise beyond the predetermined level, defined by the lower end of the wall of the duct. Above this level, the boiler compartment remains filled with air that cannot escape by any route. When the water starts to boil, the steam occupies the upper space of the boiler compartment from which it can exit, controlled by the user, from a point far from the level of the water.

Preferably, said control button comprises:

- a first portion coupled to said cover and having a first duct with a bottom wall provided with a through opening for steam;
- a second portion coupled to said first portion and having a second duct, fluidly connected—at a first end—to the first duct through said through opening and—at a second end—to said soleplate for the delivery of steam,
- at least one hole produced in said first portion that fluidly connects said first duct with said boiler compartment, wherein a pin is provided arranged in said first duct opposed by a spring, said pin being configured to slide selectively between:

a closed configuration in which said pin closes said through opening and consequently the delivery of steam towards said soleplate, and an open configuration in which said pin opens said through opening in feedback to a command given by the user on said button, which causes sliding of said pin along said first duct and opening of said through opening so that steam can flow towards the soleplate through said second duct.

Advantageously, said pin has a cap portion that—in use—is arranged outside said through opening, and is provided with a gasket, in which said cap portion in the closed configuration obstructs said through opening with said gasket interposed, and in the open configuration is detached from said through opening allowing steam to pass through.

Preferably, said pin comprises a tapered portion that, in use, is arranged at the through opening during movement of the same pin between the closed configuration and the open configuration.

The tapered portion is shaped substantially with a curved profile and allows adjustment of the flow of steam that passes through the through opening between a minimum value and a maximum value.

In this way, the control button allows the user not only to deliver or exclude the flow of steam from the holes obtained on the soleplate, but also to determine the amount of the same flow substantially as a function of the pressure that the user exerts on the button.

In other words, during the downward movement of the pin, the tapered portion slides in the through opening varying the through section, which increases progressively. This allows the user to adjust the flow of steam delivered according to the pressure exerted on the button. This function is obtained very economically without the addition of specific components.

Advantageously, there is provided a well, fluidly connected between said second duct and the through holes of said soleplate. The well is, in particular, connected to said second duct by means of a connection opening.

Preferably, said well is associated with said soleplate and has a bottom wall positioned at a lower level with respect to the upper wall of the through holes obtained in the soleplate. In this way, any water droplets that reach the well from said connection opening deposit on the bottom wall of the well and are subsequently vaporized and exit through the through holes for steam of the soleplate. This solution allows any water droplets that exit from the through holes of the soleplate to be eliminated.

Preferably, said heating means comprise:

a heating element provided with terminals for connection to the electricity supply, wherein said heating element comprises a plurality of heating portions functionally connected to one another.

In particular, said heating element is formed by four substantially linear heating portions connected to one another by a first curved portion and by a second curved portion arranged respectively in the front zone and in the rear zone.

In this way, as the element has a much greater linear extension with respect to the horseshoe-shaped heating element according to the prior art, the specific power is lower and, moreover, the concentration of heat produced at the curved portions is lower, so as to generate heating at uniform temperature and not with concentrated hot spots.

Constructionally, the second curved portion is arranged at the seat of a thermostat and of the related safety element.

In particular, during heating from cold, the thermostat can react more rapidly when the temperature rises, thereby reducing the overshoot (i.e. the difference between the temperature peak reached at the center of the soleplate starting from cold and the temperature peak reached during the thermostat cycles after the system has stabilized). The operating precision reached by the thermostat due to the positioning and to the route of the heating element is also advantageous during cooling of the soleplate, when the thermostat reacts more rapidly, preventing an excessive drop in temperature.

BRIEF DESCRIPTION OF THE DRAWINGS

Further characteristics and/or advantages of the present invention will be more apparent from the description below of several embodiments, provided purely by way of non-limiting example, with reference to the accompanying drawings wherein.

DETAILED DESCRIPTION

Figure 1:
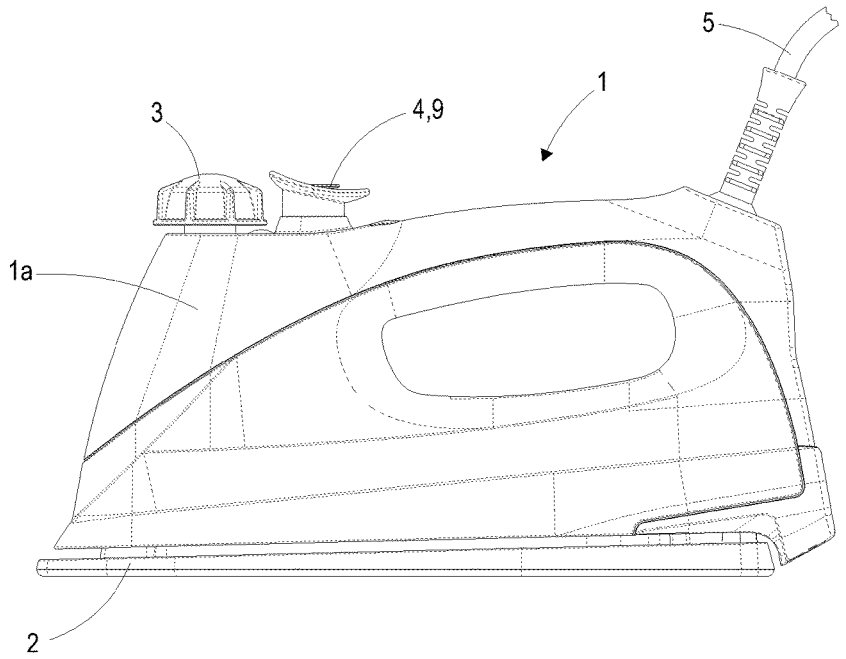
FIG. 1 shows a side view of an iron according to the present invention.

With reference to FIG. 1, there is shown an improved iron structure 1 of the type with integrated boiler, according to the present invention.

Figure 2:
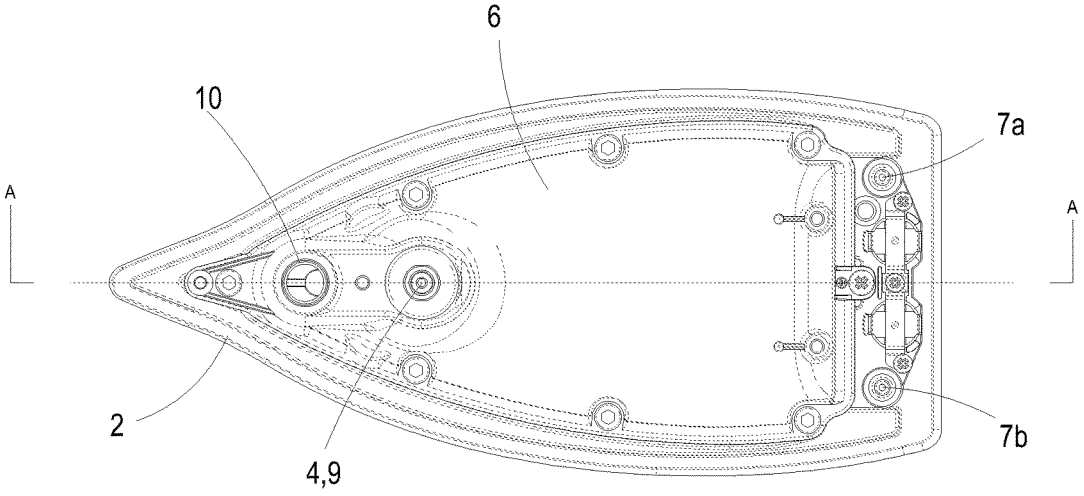
FIG. 2 shows a top sectional view with a transverse cut plane of the iron of FIG. 1.

The iron 1 mainly comprises a soleplate 2 shaped to come into contact with the laundry to be ironed, a boiler 12 (FIG. 3), fluidly connected to the soleplate 2 and adapted to produce steam, and heating means 7 (FIGS. 2 and 3) associated with the boiler 12.

The iron 1 also comprises an outer casing 1*a*, a cap 3 that closes the opening for introducing water into the iron and a button 4, 9 to be operated to obtain the delivery of steam from the soleplate 2. Electricity is supplied through the cable 5.

The button 4, 9 is functionally connected to the boiler 12 and is arranged to obtain the delivery of steam from the soleplate 2. Advantageously, the boiler 12 is produced between the soleplate 2 and a cover portion 6 arranged above the soleplate (FIG. 3) so as to define, in a coupled configuration, a fluid-tight boiler compartment 12' in which the water is boiled.

In this way, the boiler 12 is not a separate component as occurs in irons according to the prior art, but is produced as a mechanical coupling between two simple components: the base of the soleplate 2 and the top cover 6, which coupled in a fluid-tight manner with the soleplate 2 defines the boiler compartment 12'. This structure is simpler to produce as it decreases the number of components of which the iron is formed, reduces the overall dimensions and spaces and makes the iron lighter and more compact.

Figure 3:
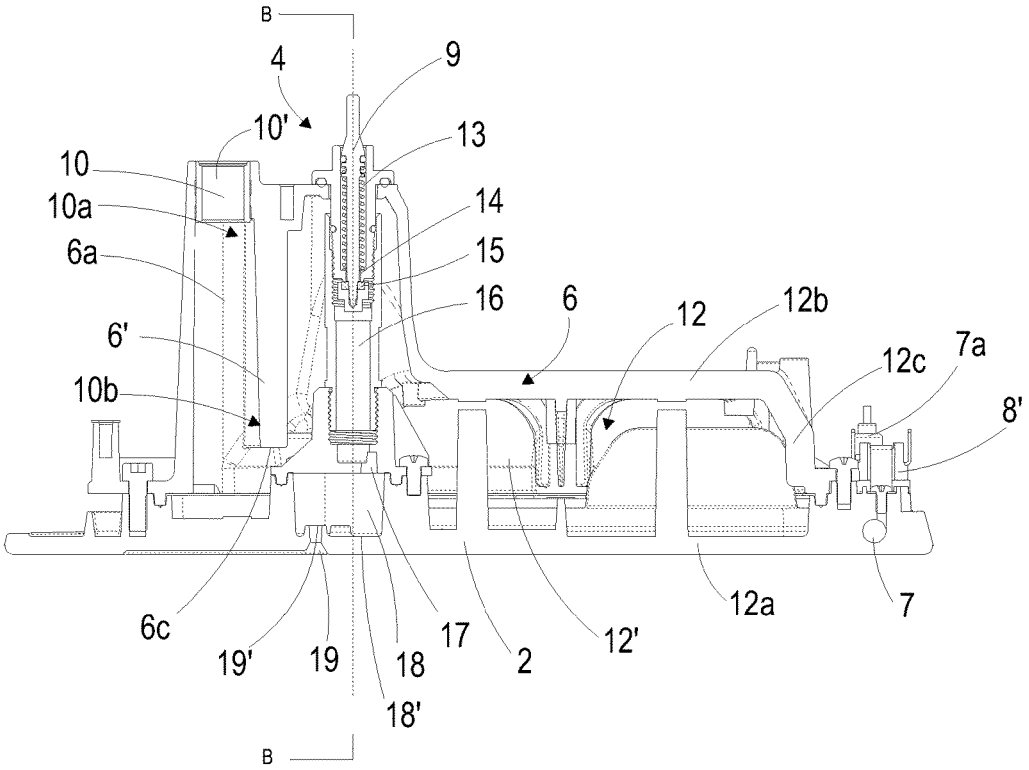
FIG. 3 shows a sectional view with a longitudinal cut plane of the iron of FIG. 1.

Constructionally, the cover portion 6 is shaped in the form of a bowl or bell facing the soleplate 2 to form the boiler compartment 12'. In particular, the boiler compartment 12' comprises a bottom wall 12*a* defined by the soleplate 2, a top wall 12*b*, opposite the bottom wall 12*a*, and lateral walls 12*c* between the bottom wall 12*a* and the top wall 12*b*. These latter are defined by the cover portion 6. As shown in FIG. 3, the cover portion 6 is coupled on the soleplate 2 by means of a screw connection with a gasket interposed.

More in detail, the cover portion 6 is shaped to comprise a control button 4, 9 of the steam, and the duct 10 for introducing water, as described in detail below. The cover portion 6 extends substantially to two heights, a first height at the boiler compartment 12' and a second greater height at the control button 9 and the duct 10.

In other construction variants these components could be mounted on the cover as distinct and separate parts.

Once again with reference to FIG. 3, the duct 10 extends between an upper end 10*a* defining a mouth 10' for the user to introduce water through, and a lower end 10*b*, opposite the upper end 10*a*.

In particular, at the duct 10 there is inserted a tube 6*a* protected laterally by a wall 6' that extends between the upper end 10*a* towards the lower end 10*b* remaining open on the lower part. The lower end 6*c* of the wall 6' delimits and circumscribes the access to the boiler compartment 12' so that the level of water introduced into the boiler compartment 12' cannot exceed a maximum predetermined level.

In this way, even if the user introduces an excess amount of water into the duct 10, the level of water in the boiler compartment 12' cannot rise beyond a certain level, defined by the lower end 6*c* of the wall 6' of the duct. Above this level the boiler compartment 12' remains filled with air, which cannot escape by any route. When the water starts to boil, the steam occupies the upper space of the boiler compartment 12' from which it can exit, controlled by the user, from a point far from the level of the water, as described in detail below.

In particular, the portion of the boiler compartment 12' that extends in the top part of the cover—substantially at the control button 9—in use is occupied only by the steam, while the liquid phase remains in the lower part thereof.

Figure 4:
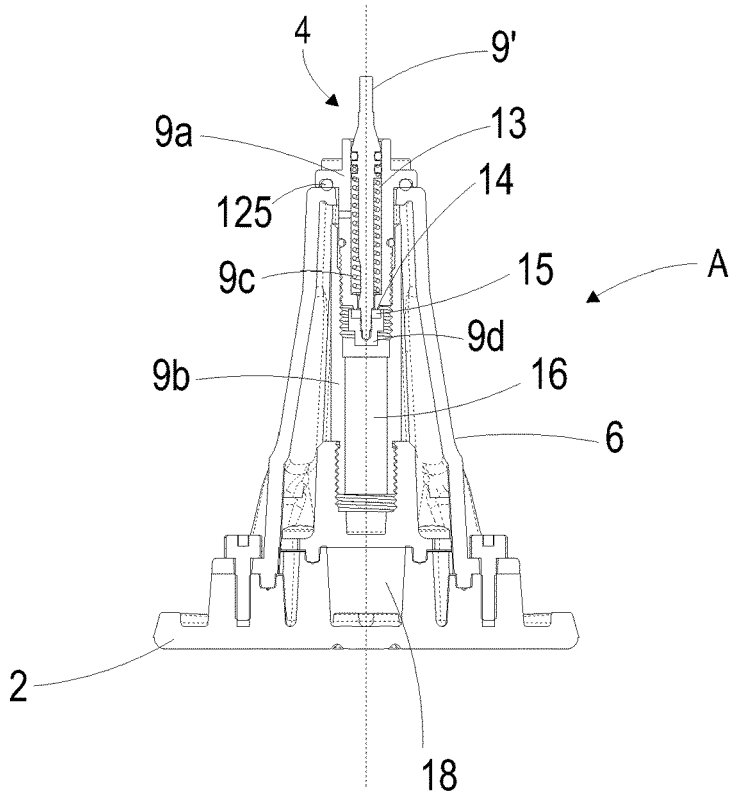
FIG. 4 shows an enlarged view of FIG. 3 relating to the control button for activating the flow of steam, in a closed configuration.
Figure 5:
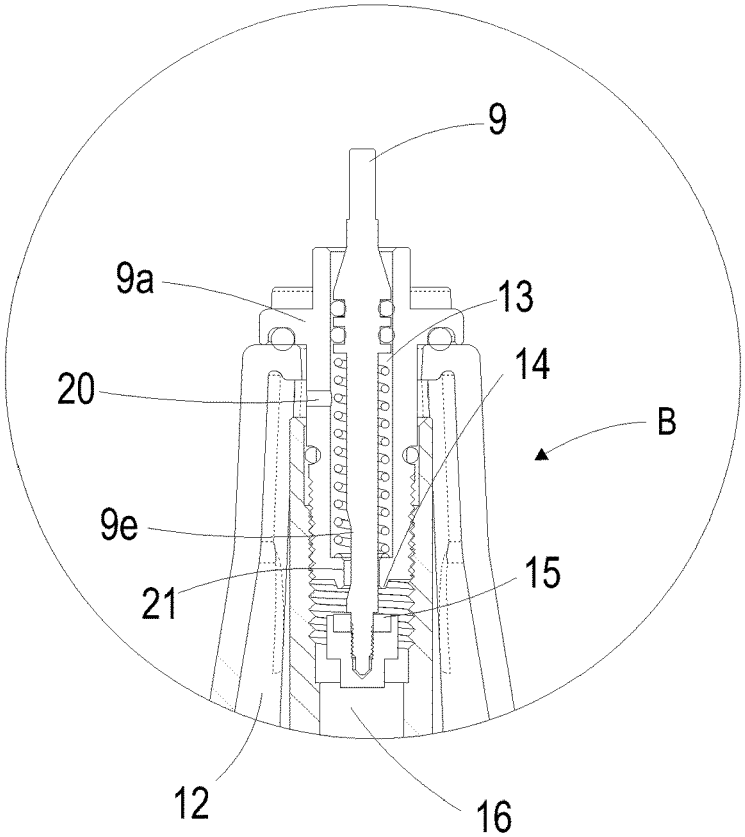
FIG. 5 shows an enlarged view of the section of FIG. 4 relating to the control button of FIG. 4 in an open configuration.

As better shown in FIGS. 4 and 5, the control button 9 comprises a first portion 9*a* coupled at the top to the cover portion 6 with sealing elements 125. The first portion 9*a* has a first duct 13 with a bottom wall 14 provided with a through hole 21 for steam (FIG. 5).

Moreover, there is provided a second portion 9*b* coupled to the first portion 9*a*, which defines a second duct 16 fluidly connected—at a first end—to the first duct 13 through the through opening 21 and—at a second end—to the soleplate 2 for the delivery of the steam, as described below. Moreover, the control button has at least one hole 20 obtained in the first portion 9*a* that fluidly connects the first duct 13 to the boiler compartment 12'.

Constructionally, the button comprises a pin 9' inserted in a fluid-tight manner in the first duct 13 and opposed by a spring 9*c*. The pin 9' is configured to slide selectively between a closed configuration A (FIG. 4) in which the pin 9' closes the through opening 21 and consequently the delivery of steam towards the soleplate 2, and an open configuration B in which the pin 9' opens the through opening 21 in feedback to a command given by the user on a button 9, which causes sliding of the pin 9' along a first duct 13 and opens the through opening 21 so that the steam can flow towards the soleplate 2 through the second duct 16.

Constructionally, the pin 9' comprises a cap portion 9*d* that, in use, is arranged outside the through opening 21 and is provided with a gasket 15. The cap portion 9*d* in the closed configuration A obstructs the through opening 21 with the gasket interposed, and in the open configuration B is detached from the through opening 21, allowing steam to pass through (FIG. 5).

In detailed construction aspects, as better shown in FIG. 5, the pin 9' comprises a tapered portion 9*e* that, in use, is arranged at the through opening 21 during movement of the same pin 9' between the closed configuration A and the open configuration B.

The tapered portion 9*e* is shaped substantially with a curved profile and allows adjustment of the flow of steam that passes through the through opening 21 between a minimum value and a maximum value. In this way, the control button 9 allows the user to activate the flow of steam but also to adjust the flow rate. In the downward movement of the pin 9', the tapered portion 9*e* slides in the through opening 21 varying the through section, which increases progressively.

In other constructional aspects, with reference to FIGS. 3 to 5, the improved iron structure according to the present invention also comprises a well 18 fluidly connected between the second duct 16 and the through holes 19 of the soleplate 2. The well 18 is in particular connected to the second duct 16 by means of a connection opening 17 (FIG. 3).

The well 18 has a bottom wall 18' positioned at a lower level with respect to the upper wall 19' of the through holes 19 obtained in the soleplate 2 (FIG. 3). This technical solution allows any water droplets that reach the well 18 from said connection opening 17 to deposit first on the bottom wall 18' without being able to exit directly—in the liquid phase—from the through holes 19. The bottom wall 18' produces a sort of basin for collecting any liquid phase that has descended from the boiler compartment 12', in which the water droplets are subjected to further vaporization and exit through the through holes 19 of the soleplate 2. This solution allows the elimination of possible water droplets exiting through the through holes of the soleplate 2, improving the ironing quality.

Further improvements of the iron according to the present invention relate to the heating means, i.e. the heating element associated with the boiler to boil the water.

Figure 6:
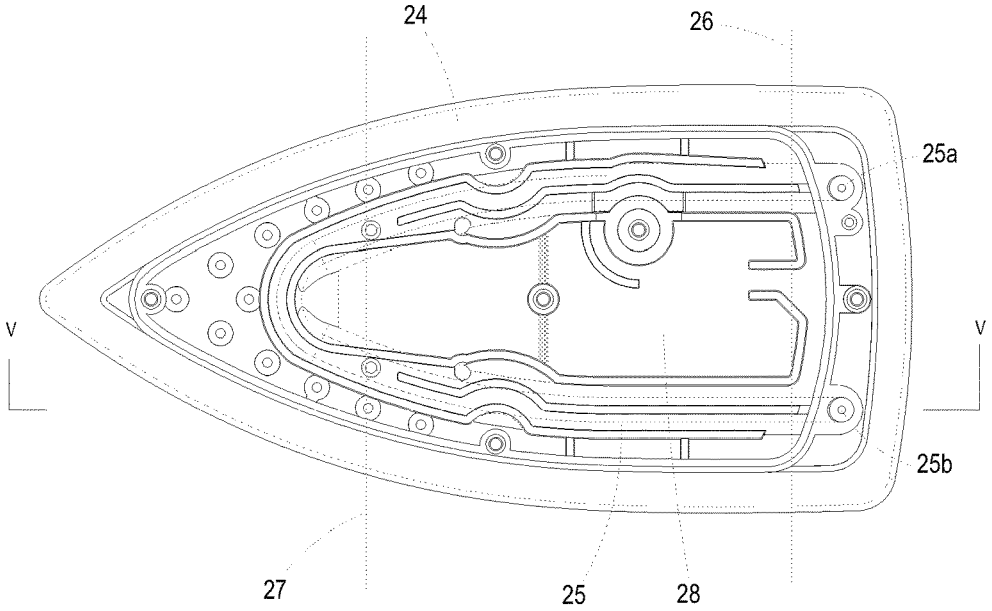
FIG. 6 (Prior Art)
FIGS. 6 to 8 respectively show a plan, sectional and schematic view of the heating means according to the prior art.
Figure 7:
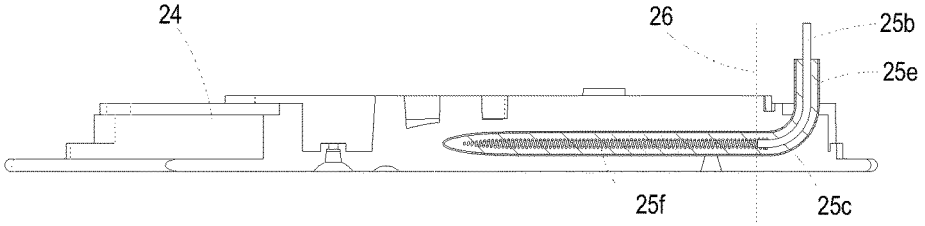
FIG. 7 (Prior Art)
Figure 8:
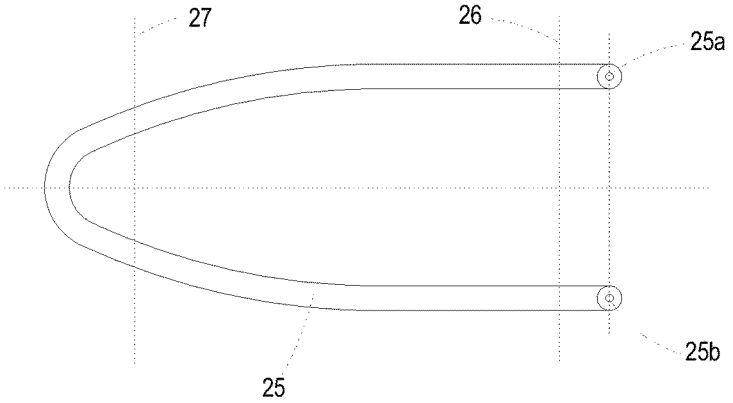
FIG. 8 (Prior Art)
Figure 9:
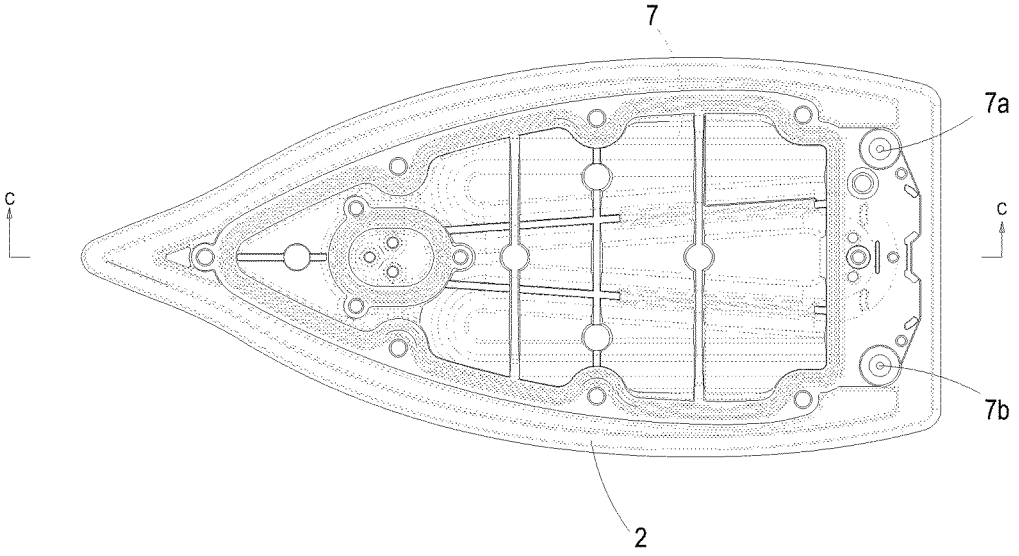
FIG. 9 shows a sectional plan view of the heating element according to the present invention.
Figure 10:
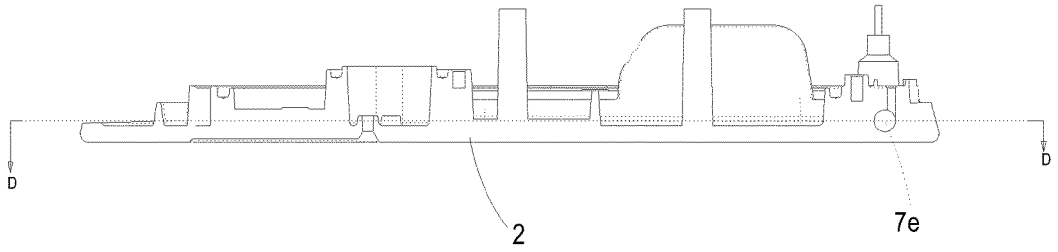
FIG. 10 shows a side view of the soleplate of the iron with the heating element fitted according to the present invention applied.

With reference to FIGS. 6 to 8, there is shown a heating element according to the prior art. FIG. 6 shows a typical soleplate 24 for an iron comprising a heating element 25 provided with terminals 25*a* and 25*b* for connection to the electricity supply. The heating element 25 is typically horseshoe shaped (FIG. 8) and is arranged so as to follow the shape of the outer profile of the soleplate 24 and the space available. The heating element 25 is of the type that is inserted into the soleplate 24 during die casting thereof.

FIG. 7 shows the soleplate 24 according to the section V-V of FIG. 6, to better illustrate how the inside of the heating element 25 is made. The heating element is formed of a coil 25*f* made of metal wire, i.e. the part that generates the heating effect; it is fastened at the two ends to the terminals 25*a* and 25*b* and is separated from an outer metal tube 25*c* by suitable insulating material 25*e*. The terminals 25*a* and 25*b* and the coil part 25*f* are inert with regard to the heating effect. Tracing an imaginary line 26 (FIG. 8) that indicates the point from which the heating element 25 is effectively active, operation of the heating element is illustrated below.

Taking as reference the imaginary line 26, it can be seen how, in use, only the part of the heating element 25 to the left of the line 26 is effectively active and "heats". The part to the right is generally called the cold zone.

In particular, it can be seen how the greatest concentration of heat emitted is found in the zone in which the two branches of the heating element 25 meet, i.e. in the zone to the left of the imaginary line 27.

In FIG. 6 imaginary lines 26 and 27 are traced. It can be noted how to the right of the line 26, there is a vast portion of the soleplate 24 that generates no heat, while the maximum concentration of heat emitted by the heating element 25 is found to the left of the line 27, where the soleplate 24 tends to narrow towards the tip. The noteworthy thermal imbalance is lessened by the fact that the aluminum of which the soleplate 24 is formed is a good heat conductor, but the differences in temperature measurable in common experience on the lower surface of the soleplate 24 are nonetheless considerable. These imbalances in temperature make it difficult to obtain a good balance of temperature and pressure inside the boiler.

Moreover, when using the iron in vertical direction, the soleplate of common use would have a great drawback: by positioning the soleplate 24 vertically, the water located in the compartment 28 (FIG. 6) would be concentrated in the zone of the imaginary line 26 where there is a minimum vaporizing capacity, making the system inefficient.

Instead, in the solution according to the present invention, the heating means, as shown in FIGS. 9 to 12, comprise a heating element 7 provided with terminals 7*a* and 7*b* for connection to the electricity supply. The heating element 7 comprises a plurality of heating portions 7', 7*c*, 7*d*, 7*e* functionally connected to one another.

Figure 11:
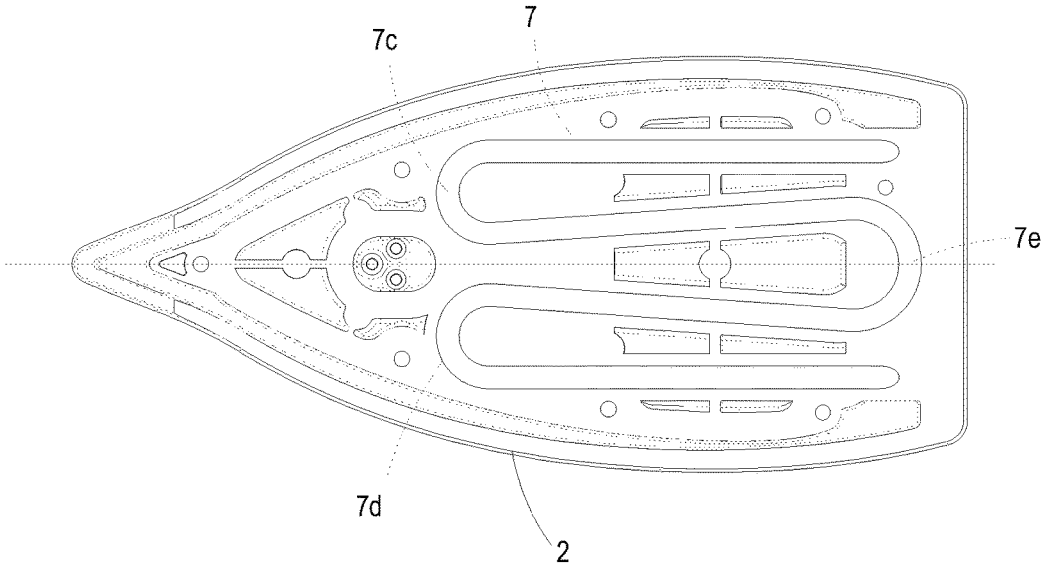
FIGS. 11 and 12 show a schematic plan view of operation of the heating element of FIG. 9.

In particular, the heating element 7 as shown in FIG. 11 is formed by four substantially linear heating portions 7' connected to one another by a first curved portion and a second curved portion arranged respectively in the front zone and in the back zone.

Figure 12:
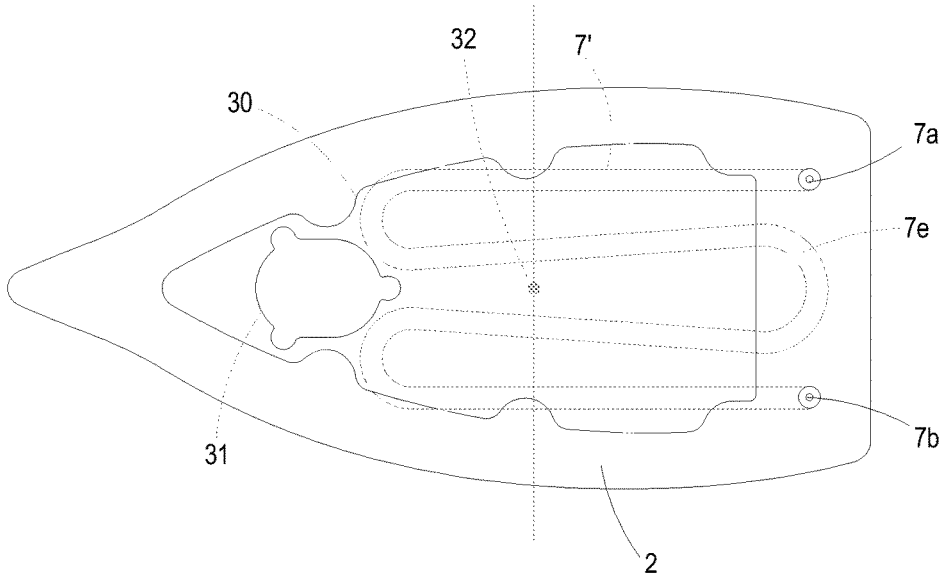

FIG. 12 shows the soleplate 2 in a schematic form, where the path of the heating element 7 is highlighted compared to the zone on the inside of the profile 30 and on the outside of the profile 31: this zone being occupied by the water in the boiler 12 in plan view (see compartment 12' of FIG. 3).

It can be observed how the shape of the heating element 7 is optimized to uniformly involve the whole of the zone occupied by the water, with great benefit to the uniformity of the temperatures and efficiency during heating. The geometric center of the soleplate 2, indicated with the point 32, is also highlighted in FIG. 12. It can be calculated that the extension of the hot part of the heating element 7 located to the right of the geometric center 32 of the soleplate 2 represents around 60% of the total extension. Also when ironing vertically, imagining that the water is all to the right of the zone described, it can be seen how there is still a substantial portion of the heating element 7 to heat this back part of the soleplate 2 directly. It can also be noted that the cold branches of the heating element 7 close to the terminals 7*a* and 7*b* are to the outside of the profile 31. During vertical heating starting from cold, besides the preceding benefit, there is a considerable limitation of overshoot as the thermostat 8' (FIG. 3) is positioned close to the curve 7*e* of the heating element 7 (FIG. 11).

In this way, as the heating element has a much larger linear extension with respect to "horseshoe-shaped" heating elements according to the prior art, the specific power is lower and, moreover, the concentration of heat produced at the curved portions is lower, so as to generate heat at a uniform temperature and not with concentrated hot spots.

The above description of several specific embodiments is able to show the invention from a conceptual point of view so that others, using the prior art, can modify and/or adapt these specific embodiments to various applications without further research and without departing from the concept of the invention and, therefore, it is understood that these adaptations and modifications will be considered technical equivalents. The means and the materials to produce the various functions can be of different kind without however departing from the scope of the invention. It is understood that the expressions and the terminology used are provided purely for descriptive purposes and therefore are not limiting.

What is claimed is:

1. A steaming iron comprising:

a soleplate provided with through holes for steam adapted to come into contact with the fabrics to be ironed;

a boiler adapted to produce steam, fluidly connected to said soleplate;

a duct for introducing water into said boiler;

heating means associated with said boiler;

a control button, functionally connected to the boiler and arranged to obtain the delivery of steam through the through holes of said soleplate;

characterised in that said boiler is produced as fluid-tight coupling between said soleplate and a cover portion to form a boiler compartment in which the water is boiled wherein said cover portion is shaped in the form of a bowl or bell with an open face that couples with said soleplate that closes said open face to form said boiler compartment;

wherein said duct extends between an upper end that defines a mouth for introducing water and a lower end, opposite the upper end, provided with a wall that extends laterally to said duct between said upper end towards said lower end, so that the lower end of the wall delimits and circumscribes the access to the boiler compartment so that the level of water introduced into the boiler compartment cannot exceed a predetermined maximum level.

2. A steaming iron comprising:

a soleplate provided with through holes for steam adapted to come into contact with the fabrics to be ironed;

a boiler adapted to produce steam, fluidly connected to said soleplate;

a duct for introducing water into said boiler;

heating means associated with said boiler;

a control button, functionally connected to the boiler and arranged to obtain the delivery of steam through the through holes of said soleplate;

characterised in that said boiler is produced as fluid-tight coupling between said soleplate and a cover portion to form a boiler compartment in which the water is boiled wherein said cover portion is shaped in the form of a bowl or bell with an open face that couples with said soleplate that closes said open face to form said boiler compartment;

wherein said control button comprises:

a first portion coupled to said cover and having a first duct with a bottom wall provided with a through opening for steam;

a second portion coupled to said first portion and having a second duct, fluidly connected at a first end to the first duct through said through opening and—at a second end—to said soleplate for the delivery of steam, at least one hole produced in said first portion that fluidly connects said first duct with said boiler compartment, wherein a pin is provided arranged in said first duct opposed by a spring, said pin being configured to slide selectively between:

a closed configuration in which said pin closes said through opening and consequently the delivery of steam towards said soleplate, and an open configuration in which said pin opens said through opening in feedback to a command given by the user on said button, which causes sliding of said pin along said first duct and opening of said through opening so that steam can flow towards the soleplate through said second duct.

3. Steaming iron according to claim 2, wherein said pin has a cap portion that, in use, is arranged outside said through opening, said cap portion being provided with a gasket, so that said cap portion in said closed configuration obstructs said through opening with said gasket interposed, and said cap portion in said open configuration is detached from said through opening allowing steam to pass through.

4. Steaming iron according to claim 2, wherein said pin comprises a tapered portion that, in use, is arranged at the through opening during movement of the same pin between the closed configuration and the open configuration.

5. Steaming iron according to claim 4, wherein said tapered portion is shaped substantially with a curved profile and allows adjustment of the flow of steam that passes through the through opening between a minimum value and a maximum value.

6. Steaming iron according to claim 5, wherein during the downward movement of said pin, said tapered portion slides in the through opening varying the through section, which increases progressively, so that the user can adjust the flow of steam delivered according to the pressure exerted on the button.

7. Steaming iron according to claim 2, wherein there is provided a well, fluidly connected between said second duct and the through holes of said soleplate, said well being fluidly connected to said second duct by means of a connection opening.

8. Steaming iron according to claim 7, wherein said well is associated with said soleplate and has a bottom wall positioned at a lower level with respect to the upper wall of said through holes obtained in the soleplate, so that any water droplets that reach the well from said connection opening deposit on the bottom wall of the well and are subsequently vaporized and exit through the through holes for steam of the soleplate.

* * * * *